United States Patent [19]

Cole et al.

[11] 4,362,205

[45] Dec. 7, 1982

[54] ROTOR DIE CASTING METHOD

[75] Inventors: James C. Cole, Galion; George F. Cronenwett, Mount Gilead, both of Ohio

[73] Assignee: HPM Corporation, Mount Gilead, Ohio

[21] Appl. No.: 230,455

[22] Filed: Feb. 2, 1981

[51] Int. Cl.[3] ..... B22D 19/00

[52] U.S. Cl. ..... 164/109; 164/113; 164/131; 164/121; 164/137; 164/333; 164/344

[58] Field of Search ..... 164/113, 119, 130, 303, 164/332, 333, 344, 131, 137, 121, 109

[56] References Cited

U.S. PATENT DOCUMENTS

| | | | |
|---|---|---|---|
| 3,315,315 | 4/1967 | Triulzi | 164/303 |
| 3,584,345 | 6/1971 | Beastrom | 164/109 |
| 3,608,622 | 9/1971 | Bachelier | 164/109 |
| 3,866,666 | 2/1975 | Wunder | 164/109 |
| 4,064,928 | 12/1977 | Wunder | 164/264 |

*Primary Examiner*—Gus T. Hampilos
*Assistant Examiner*—Richard K. Seidel
*Attorney, Agent, or Firm*—Gust, Irish, Jeffers & Hoffman

[57] ABSTRACT

A method for the die casting of end rings and conductor bars in rotors employing a die casting machine having a compensator mechanism comprising a compensator sleeve and a compensator for reciprocal movement along a first axis. A coaxially movable die plate closes off one end of the compensator sleeve to form a die cavity for casting. A plurality of lamination stacks, each held together by a removable stacking pin, are stored on an inclined loading rack positioned laterally on one side of the compensator mechanism. A few of these stacks roll down inclined planes into the compensator sleeves. The compensator pushes the stacks forward into abutment with the die plate and a charge of molten material is injected into the die cavity. The die plate then moves axially away from the compensator and a retriever moves perpendicular to the first axis to an unload position between the compensator sleeve and die plate. The cast rotor is then pushed out of the sleeve and into the retriever, partially by the compensator and completely by injector rods housed within the compensator. The retriever is then retracted to its original position where the stacking pins are pressed out and the rotors are ejected from the retriever onto inclined, V-shaped chutes. A second set of stacks may be loaded and moved into the die cavity simultaneously with pin press-out and rotor ejection.

19 Claims, 13 Drawing Figures

ROTOR DIE CASTING METHOD

BACKGROUND OF THE INVENTION

The present invention relates to a method for die casting the end rings and conductor bars on and in a stack of laminations to thereby form a rotor for use in an electric motor. The invention is related to the automatic loading apparatus disclosed in patent application Ser. No. 115,770 filed Jan. 25, 1980, now U.S. Pat. No. 4,271,895 and entitled Automatic Part Loader Unit for Multi-Cavity Rotor Die and Method of Operation. This patent is expressly incorporated herein by reference.

In the manufacture of squirrel cage rotors for electric motors, it is common practice to form them of a plurality of stacked, circular laminations each having a central opening and a plurality of openings positioned in a circular array near the peripheral edge of the lamination. The laminations are stacked on a stacking pin with the peripheral openings aligned, either along axes parallel to the central axis of the stack, or with a slight skew from one lamination to the next so that the openings collectively form a plurality of partially helical passages or channels axially through the stacked laminations.

These rotor preforms are then loaded into the die cavities of a die casting machine, and molten aluminum is injected into the cavities whereupon it flows through the channels in the stacked laminations to form the conductor bars and end rings on opposite ends of the stack of laminations, which provide electrical interconnection between the conductor bars. The end rings may either be formed smooth or with fins for the purpose of cooling. The formed rotors are then removed from the die casting machine, and the stacking pins are pressed out so that the rotor assembly is held together by means of the cast aluminum end rings and conductor bars.

In the past, the lamination stacks have been hand loaded directly into the die cavities through the parting line of the separated die plates. The die plates were then closed and a shot of molten aluminum or other suitable metallic material injected into the die cavities to form the conductor bars and end rings. Subsequently, the die plates were opened and the cast rotors removed by hand and transported to the pin press out station.

Later, automatic die casting machines were developed whereby the lamination stacks could be automatically loaded and retrieved from the die cavities, and the stacking pins were pressed out with the cast rotors still in the retriever. The loader moved laterally between the separated dies from one side of the compensating mechanism, and following casting, the retriever moved between the parting line of the die plate from the other side of the compensating mechanism. Although this eliminated manual handling of the lamination stacks and rotors, the process is quite cumbersome and requires a large amount of floor space. This is because the flow of material is generally linear through the machine with the stacked lamination preforms being loaded laterally from one side of the compensator-casting plunger axis and being retrieved from the opposite side thereof. Thus, two operators for the machine were necessary, one to load the stacked lamination preforms into the machine and the other to retrieve the cast rotors. Since the pressed out pins are immediately recycled to form new stacked lamination preforms, they must either be transported around to the opposite side of the die casting machine where the stacking pin press is located, or, if the pin press is located on the discharge side of the machine, then the stacked lamination preforms themselves must be transported around to the loading side of the machine.

SUMMARY OF THE INVENTION

The method of rotor die casting according to the present invention requires only a single operator for the machine because the material flow path is rectangular rather than linear, as in the case of the example cited above. The stacked lamination preforms are loaded in an automatic loader of the type disclosed in the aforementioned patent application Ser. No. 115,770 from the operator side of the compensator mechanism, and the preforms are then automatically loaded into the compensator sleeves through breech openings in the sides thereof. Following casting of the end rings and conductor bars, a retriever moves laterally between the compensator sleeves and the die plate from the same side of the machine on which the loading racks are located, the cast rotors are inserted into the retriever, and the retriever then retracts to its original position for pin press out and rotor ejection. Thus, the preforms are loaded laterally into the machine, move axially to the die cavities, are retracted laterally in the opposite direction as that of loading, and the pins are pressed out and rotors ejected into bins or holding chutes all on the same side of the machine. This enables the stacking pin press also to be located on this side of the machine so that a single operator can load and monitor all functions of the machine from just one side thereof.

Specifically, the present invention relates to a method for die casting end rings and conductor bars on motor rotors in a die casting machine including a compensator mechanism comprising a compensator sleeve having a breech opening in the side thereof and a compensator received in the sleeve for reciprocal movement along a first axis, and a die plate closing off one end of the compensator sleeve to form a die cavity therein, the die plate and compensator sleeve being axially separable. A plurality of stacks of motor laminations, each stack being held together by a stacking pin, are stored on a loading rack positioned laterally on one side of the compensator mechanism and the first axis, and one of the stacks is caused to roll by gravity from the loading rack into the compensator sleeve through the breech opening thereof. The stack is then pushed forward in the compensator sleeve by the compensator into abutment with the die plate, and a charge of molten material is injected into the die cavity formed by the compensator, compensator sleeve and die plate on and through the stack to form end rings and conductor bars on the stack to thereby complete the rotor. The die plate and compensator sleeve are then axially separated, and a retriever is moved laterally from said one side of the first axis perpendicularly toward the first axis to an unload position interposed between the compensator sleeve and die plate, the retriever having an opening aligned with the compensator sleeve when it is moved to its unload position. The cast rotor is pushed out of the compensator sleeve and into the retriever opening and clamped therein, following which the retriever is retracted to a position on said one side of the compensator mechanism and first axis. While the rotor is in the retriever and when the retriever has been retracted, the stacking pin is pressed out of the rotor along a second axis substantially parallel to the first axis and the rotor is ejected out of the retriever opening along said second axis. After the retriever has retracted away from the compensator sleeve and die plate, the die plate and compensator sleeve are brought together, and subsequent to clearing of the retriever from between the compensator sleeve and die plate but prior to ejection of the rotor from the retriever opening, another stack is rolled into the compensator sleeve and pushed forwardly in the compensator sleeve toward the die plate.

The invention is not limited to a single cavity operation, but covers multiple cavity die casting methods wherein two, four, eight or any other suitable number of rotors are loaded, cast and retrieved simultaneously.

It is an object of the present invention to provide a method for die casting rotors which requires only a single operator that can load and monitor the operation of the machine from one side thereof.

It is another object of the present invention to provide a method for die casting rotors wherein the lamination stack preforms and the cast rotors move in a rectangular pattern through the machine so that the stacked lamination preforms can be loaded into the machine on the same side that the cast rotors and stacking pins are discharged.

Yet another object of the present invention is to provide a method for die casting rotors wherein a number of the steps can be accomplished simultaneously thereby reducing the overall cycle time and improving efficiency.

These and other objects will be apparent from the detailed description of a preferred embodiment of the invention taken together with the appropriate drawing figures.

DETAILED DESCRIPTION

Figure 1:
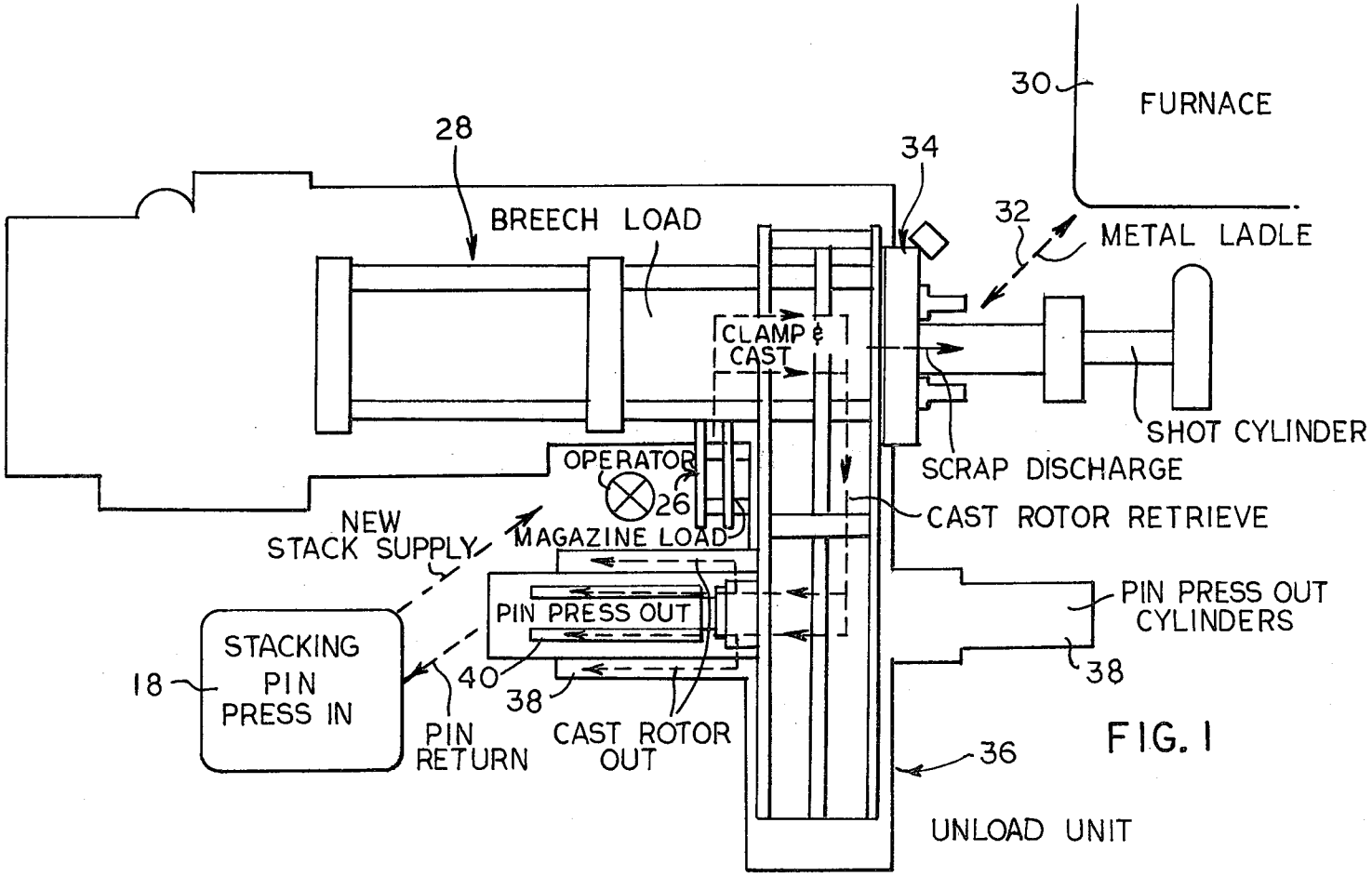
FIG. 1 is a schematic plan view of a die casting machine showing the method according to the present invention.
Figure 2:
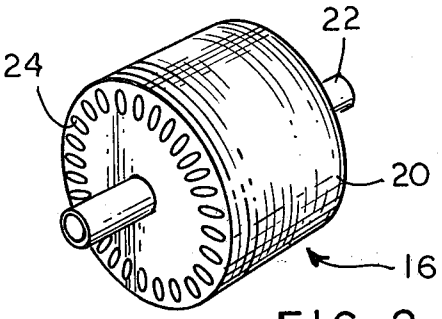
FIG. 2 is a perspective view of a stacked lamination preform prior to casting of the end rings and conductor bars.

With reference now to the drawings, and in particular FIG. 1, a die casting machine performing the method according to the present invention is illustrated schematically. The stacked lamination preforms 16 shown in FIG. 2 are assembled in stacking pin press in unit 18, and comprise a plurality of circular laminations 20 stacked on a removable stacking pin 22. Stacking pin 22 extends through a central opening within laminations 20, which are provided with a circular array of peripheral openings 24 aligned either along axes coaxial with the central axis of preforms 16 or skewed slightly relative to each other so as to form partially helical channels therein.

From the stacking pin press, preforms 16 are loaded by the operator into the rack of gravity-fed loading mechanism 26 of the type disclosed in the aforementioned U.S. Pat. No. 4,271,895. The escapement mechanism operates once during each cycle of the machine to cause either one or a plurality, such as two or four, of the preforms 16 to roll down inclined tracks and through breech openings in the compensator sleeves of the compensator mechanism indicated generally as 28. The preforms 16 are then rammed forwardly by the compensators into the die cavities and molten metal, such as high purity aluminum, is injected into the cavities to cast end rings on and conductor bars through the rotor preforms 16. The metal is melted in furnace 30 and ladled by an autoladle 32 into the shot injection mechanism 34.

Following casting of the end rings and conductor bars, the plates separate and the metal scrap which solidifies in the shot passages and sprues is stripped and falls downwardly into a scrap bin. The cast rotors are then retrieved by means of a retriever which moves laterally between the open plates where it receives the cast rotors, and then retracts to the unload and press out unit 36 along the same axis. Pin press out cylinders 38 then actuate rods and sleeves which press out the pins through tubes 40 and eject the cast rotors from the retriever onto the rotor chutes 38. The cast rotors are removed for subsequent installation in motors, and the pins are reused in the stacking operation performed by unit 18.

It should be noted that the apparatus can be operated by a single operator standing adjacent the magazine load unit because the stacked lamination preforms 16 follow a rectangular flow path to the machine thereby localizing the input and output of the machine to a single side thereof. Moreover, the rectangular flow path of the parts minimizes the floor space which is required for the machine and minimizes transfer of the stacking pins and stacked lamination preforms from one side of the machine to the other.

As mentioned earlier, the method of the present invention can be used for either single or multiple cavity operation. For the sake of simplicity and clarity, the method will be described in relation to a dual cavity machine, although the machine can be expanded to four or even more cavities, if desired.

Figure 3:
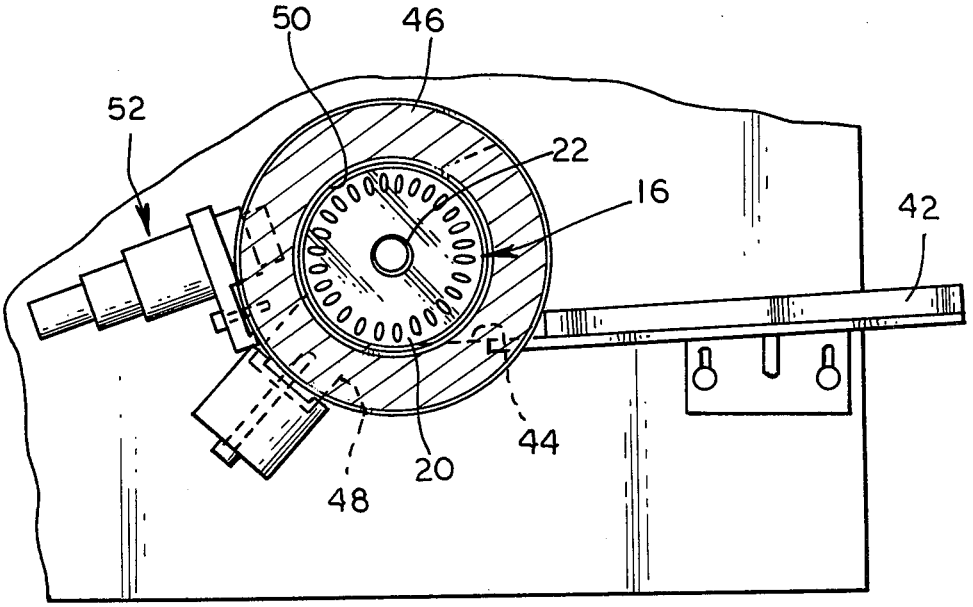
FIG. 3 is an end elevational view, partially in section, of one of the compensator sleeves having a stacked lamination preform received therein.

To initiate the cycle, the escapement mechanism described in U.S. Pat. No. 4,271,895 is actuated and a pair of rotor preforms 16 roll down respective inclined tracks 42 through openings 44 in compensator sleeves 46, as shown in FIG. 3. Preforms 16 are held in place by a magnet 48 and the proper positioning thereof within the bore 50 of compensator sleeve 44 is detected by sensor 52. At this time, the autoladle 32 (FIG. 1) moves to its dip or fill position within furnace 30, fills a measured shot, and then traverses to the shot injection mechanism 34.

Figure 4:
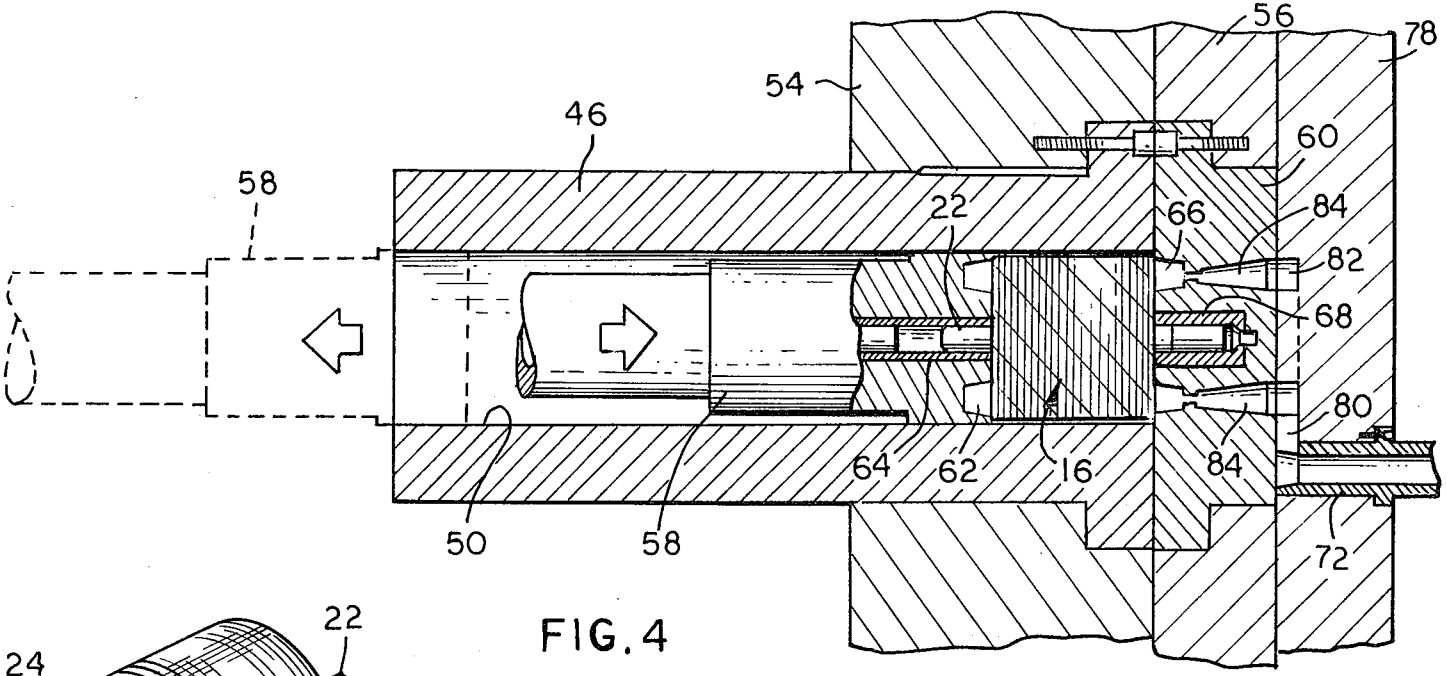
FIG. 4 is a sectional view of one of the compensator sleeves showing a stacked lamination preform received therein and wherein the compensator is shown both in its full forward position and in a dotted line retracted position.

When rotors 16 are properly seated within compensator sleeves 46, die plate 54 moves forward carrying with it compensator sleeves 46 until compensator sleeves 46 and plate 54 are in tight engagement with movable die plate 56 (FIG. 4). At this time, hydraulically actuated compensators 58 are moved forward thereby ramming rotor preforms 16 against inserts 60 connected to plate 56 and develop full pressure. It will be noted that each compensator 58 has an annular end cavity 62 therein to form one of the end rings of the cast rotor and a center sleeve 64 having an internal diameter adapted to seat the stacking pin 22 of preform 16. Similarly, each insert 60 has an annular cavity 66 therein to form the other end ring and a bushing 68 dimensioned to seat the other end of stacking pin 22. When full pressure is developed on compensators 50, they tightly clamp preforms 16 between them and the inserts 60 of plate 56 so that the molten aluminum will be confined to annular cavities 62 and 66 and the passages formed by aligned peripheral openings 24 in the laminations 20.

Figure 5:
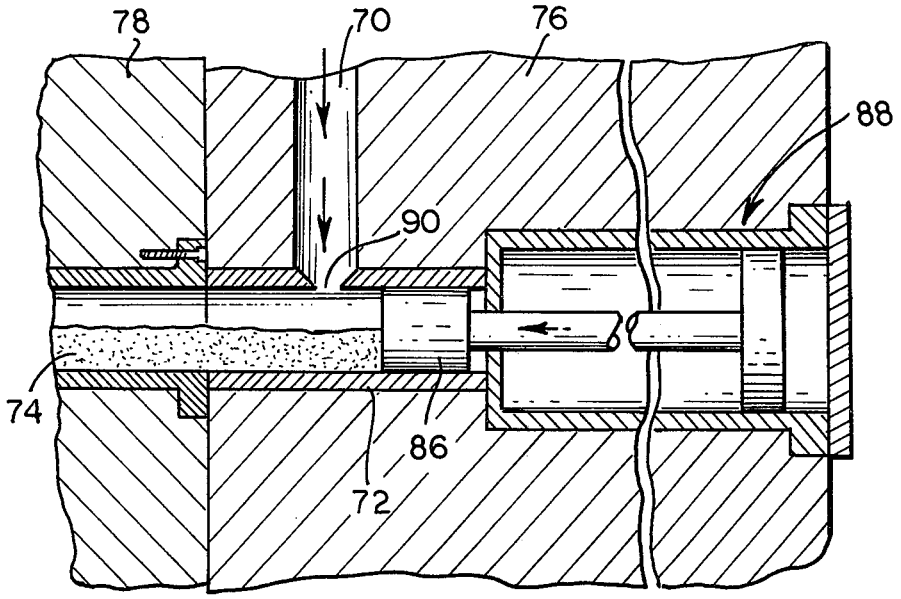
FIG. 5 is an elevational, sectional view showing the shot injector with the shot sleeve partially filled with molten metal and the shot plunger moving forwardly on its injection stroke.

The autoladle 32 pours the molten aluminum downwardly through fill passage 70 (FIG. 5) into shot sleeve 72 wherein it forms a pool 74. Fill passage 70 is formed within stationary plate 76 and shot sleeve 72 extends from fill passage 70 within plate 76 through the stationary plate 78 to passage 80 and from there through annular chamber 82 and a plurality of circularly arranged sprues 84 into the die cavities formed by compensators 58, compensator sleeves 46 and die plate 56. The shot is injected by plunger 86 received within shot sleeve 72 and actuated by a hydraulic cylinder 88 within stationary plate 76. Plunger 86 first moves forward at slow speed to gradually fill the shot sleeve 72 with the molten aluminum 74, which will occur sometime after plunger 86 clears the opening 90 in fill passage 70. When shot sleeve 72 is full, plunger 86 will be advanced at high speed to rapidly inject the molten aluminum through passage 80 chamber 82 and sprues 84 into the die chambers within which the stacked lamination preforms 16 are clamped. Plunger 86 holds this position for a predetermined length of time, after which die plate 54 and compensator sleeves 46 retract and movable plate 56 is pressed forward by hydraulic cylinder 94 and connecting rod 96 so that plates 54, 56, 78 and 76 occupy the positions illustrated in FIG. 6.

Figure 6:
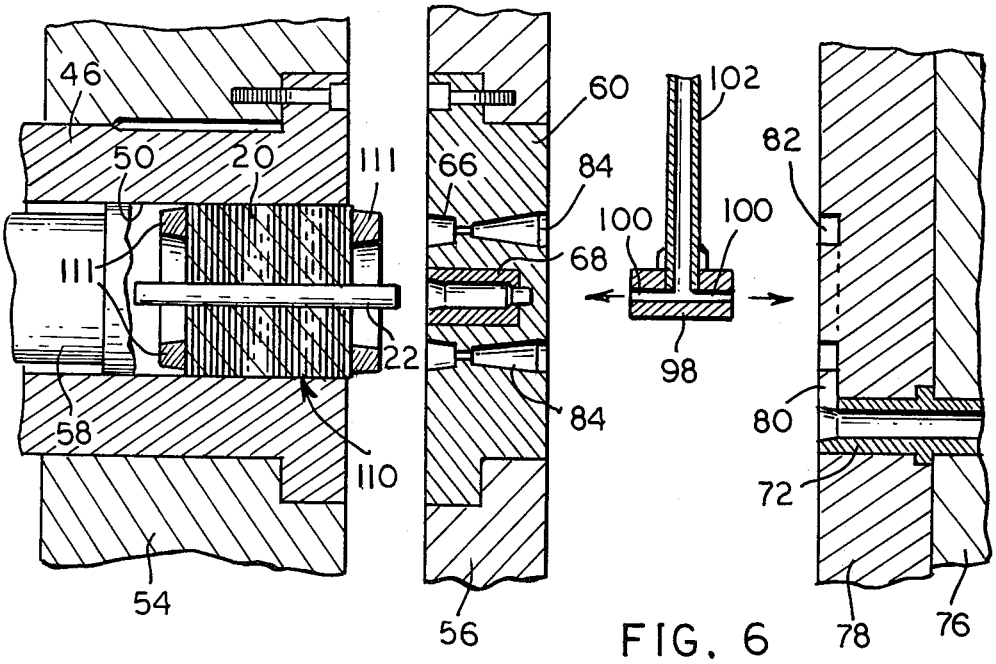
FIG. 6 is an elevational, sectional view showing the plates separated following casting of a rotor and showing the die lubricant sweep bar between the movable die plate and the stationary plate.
Figure 7:
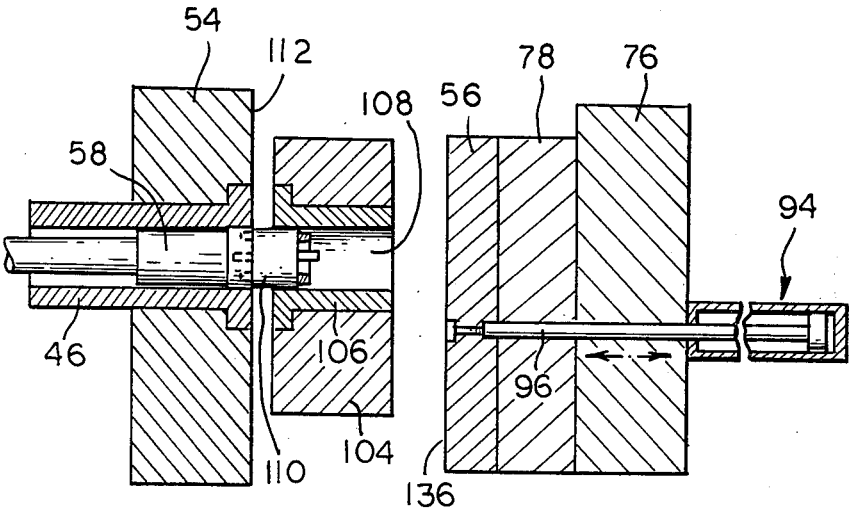
FIG. 7 is a reduced size elevational, sectional view showing the cast rotor being inserted into the retriever opening by the compensator.
Figure 8:
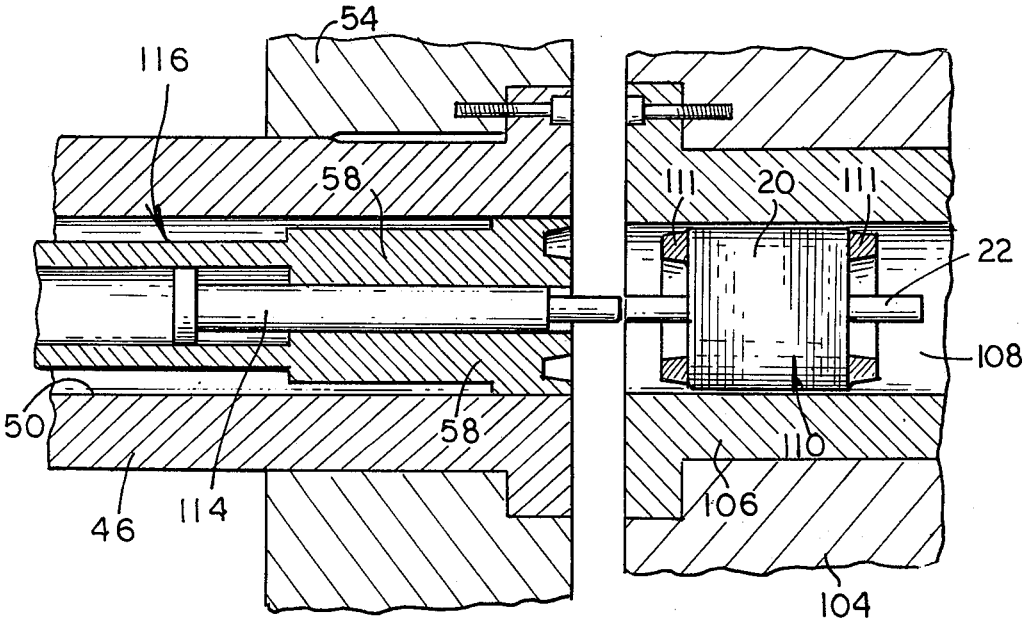
FIG. 8 is an enlarged sectional view showing the cast rotor being fully inserted into the retriever opening by the ejector plunger.

The scrap is then stripped off plate 78 and falls downwardly into a bin beneath plates 54, 56, 78 and 76. Sweep bar 98 then moves vertically downward as shown in FIG. 6 between movable die plate 56 and stationary plate 78, blasting plates 56 and 78 with pressurized air as it moves down. Shot plunger 86 (FIG. 5) is then retracted and sweep bar 98 is raised spraying plates 56 and 78 with a conventional die lubricant through nozzles 100, the lubricant being supplied to sweep bar 98 through a conduit indicated schematically as 102. When sweep bar 98 has been raised to the point where it clears plates 56 and 78, movable die plate 56 is retracted against stationary plate 78 to the position illustrated in FIG. 7. At this time, retriever 104 moves transversely from the unload unit (FIG. 1) along an axis substantially perpendicular to the axis of movement of compensators 58 to a position between fully retracted movable die plate 56 and die plate 54 as shown in FIG. 7. Retriever 104 includes a pair of sleeves 106 having openings 108 therein dimensioned to receive the cast rotors now indicated by the reference numeral 110. Compensators 58 are then advanced forward until they are substantially flush with the face 112 of plate 54, and this action pushes the cast rotors 110 partially into the openings 108 and retriever 104. As shown in FIG. 8, the cast rotors 110 are pushed completely within openings 108 by ejector rods 114 slidably received within and coaxial with compensators 58 and actuated by means of hydraulic cylinders 116.

Figure 9:
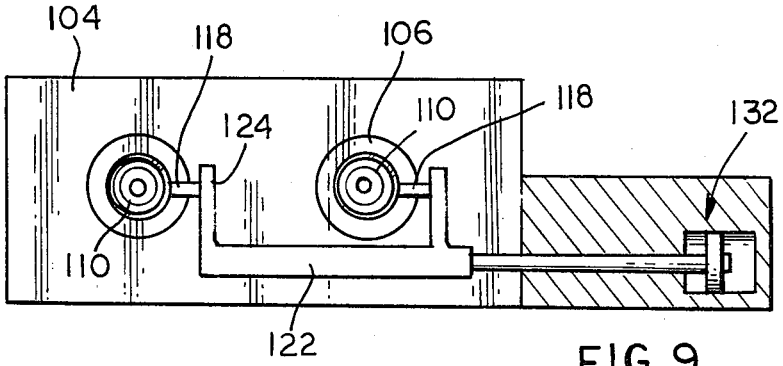
FIG. 9 is an elevational view of the face of the retriever and its rotor clamping mechanism.
Figure 10:
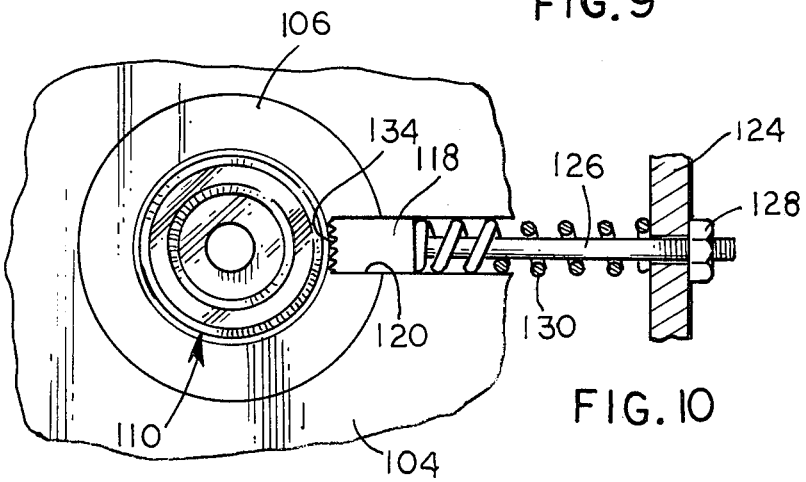
FIG. 10 is an enlarged view of one of the retriever openings and the rotor clamp mechanism.

When rotors 110 have been fully inserted within openings 108 in retriever 104, ejector rods 114 are retracted and the rotors 110 are clamped in place by means of the mechanism illustrated in FIGS. 9 and 10, so that they will not fall out of retriever 104 as it is retracted to its original position within the pin press out unit. Clamp mechanisms comprise serrated clamp elements 118 that are slidably received within bores 120 in sleeves 106. Elements 118 are connected to plates 124 by rods 126 and backer nuts 128. Springs 130 are coiled around rods 126 and are in engagement with the clamp elements 110. When bracket 122 is urged to the left (as viewed in FIG. 9) by hydraulic cylinder 132, springs 130 are compressed thereby urging serrated clamp elements 118 against the sides of rotors 110. The serrations 134 frictionally hold rotors 110 in place so that they will not fall out of retriever 104 as it is retracted. By using springs 130 as the force transferring element, a unitary bracket 122 and a single hydraulic cylinder 132 can be utilized for clamping a plurality of rotors 110.

Figure 11:
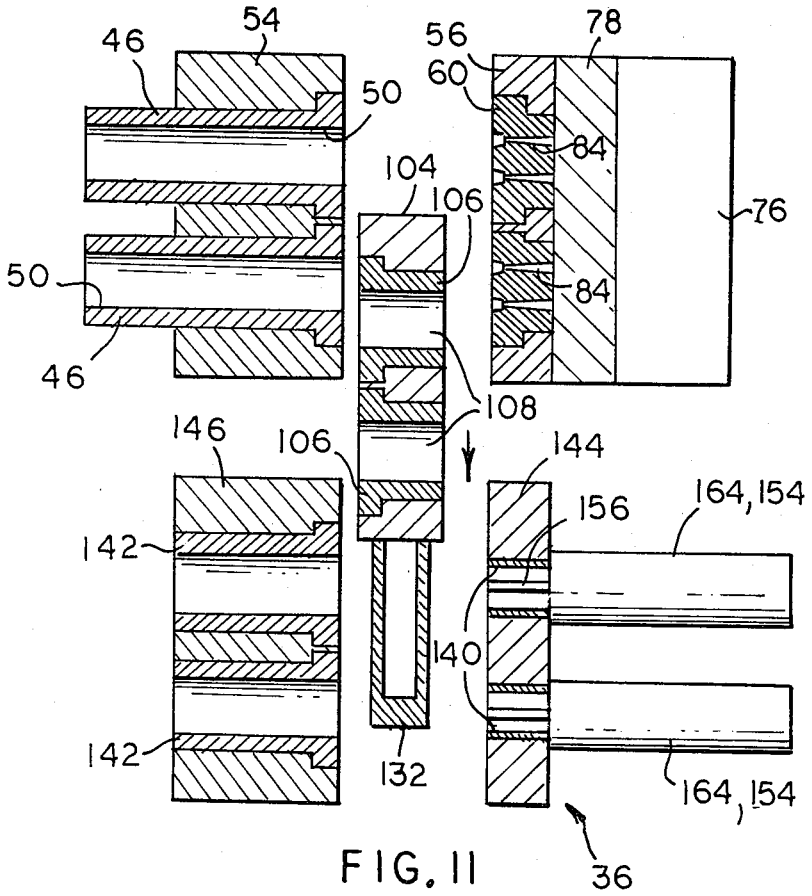
FIG. 11 is a plan view showing the retriever retracting to a position within the pin press out station.

Retriever 104 is then hydraulically retracted from between plates 54 and 56, and it sprays a conventional die lubricant on the faces 112 and 136 of plates 54 and 56, respectively. At the same time, compensators 54 and ejector pins 114 have fully retracted, and the escapement mechanism permits another pair of stacked lamination preforms 16 to roll down tracks 42 into compensator sleeves 46. When retriever 104 has fully retracted to its position within the pin press out unit 36, hydraulic cylinder 132 releases clamp bracket 122 thereby releasing rotors 110, which loosely remain within openings 108. FIG. 11 illustrates retriever 104 retracting to the pin press out unit 36.

After retriever 104 clears plates 54 and 56, plate 54 and compensator sleeves are moved forward into abutment with movable plate 56, carrying with them rotor preforms 16. At this time, autoladle 32 dips to receive another charge of molten metal and begins to traverse to the shot injection unit 34.

Figure 12:
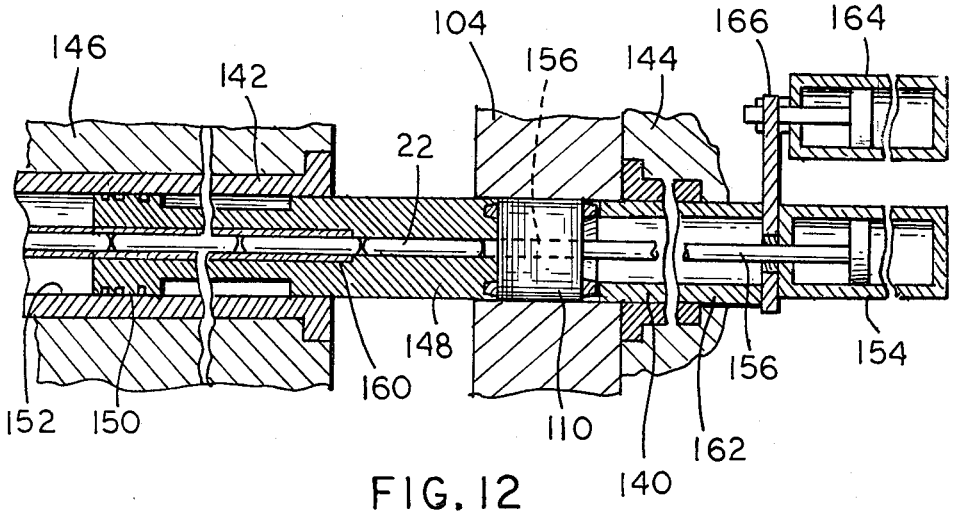
FIG. 12 is an enlarged, elevational sectional view of the pin press out and rotor ejector mechanism.
Figure 13:
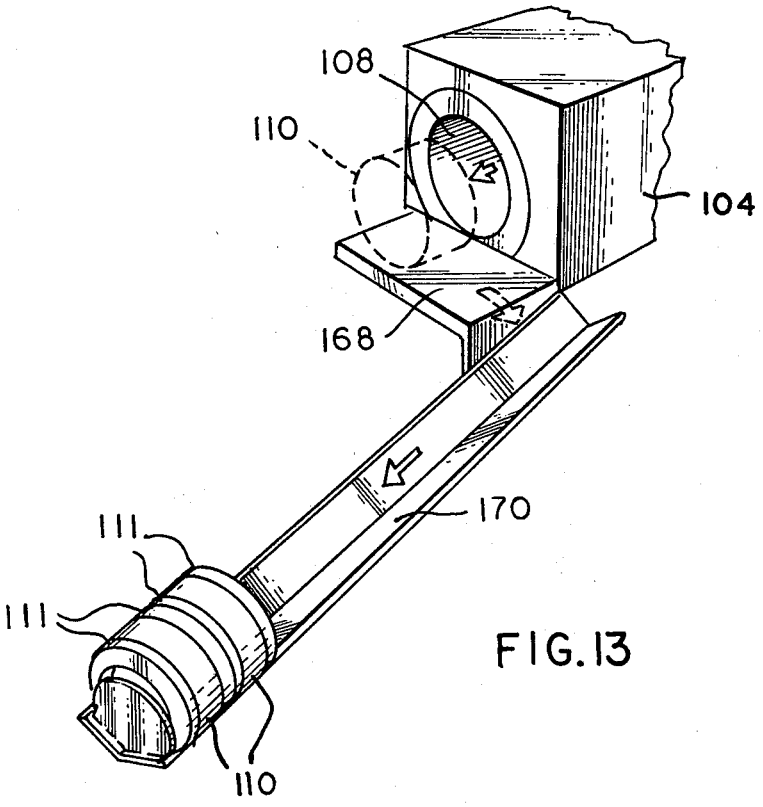
FIG. 13 is a perspective view showing a cast rotor being ejected from the retriever and onto the inclined chute assembly.

Referring now to FIGS. 11 and 12, once retriever 104 is fully retracted, the openings 108 therein will be in alignment with sleeves 140 and 142 in plates 144 and 146, respectively, in the pin press out unit 36. A pair of anvils 148 actuated by pistons 150 within bores 152 in sleeve 142 will be advanced into engagement with rotors 110, and hydraulic cylinders 154 will drive pin press out plungers 156 forward into engagement with the stacking pins 22 in rotors 110 and push pins 22 out of rotors 110 through anvils 148 into open ended discharge tubes 160. The hydraulic pressure on anvils 148 holds rotors 110 against movement as pins 22 are being pressed out. Anvils 148 are then retracted by pistons 150 and rotor ejector sleeves 162 are pushed forward by hydraulic cylinder 164 and plate 166 out of the openings 108 in retriever 104 so that they drop onto inclined ramps 168 and from there roll into inclined V-shaped chutes 170, wherein they are stacked for subsequent removal.

While pins 22 are being pressed out and rotors 110 are ejected from retriever 104, compensators 58 are driven forward to develop final pressure on the new set of rotor preforms 16 within compensator sleeves 46 (FIG. 4), and a new shot of molten material is injected into the die cavities as described earlier. The ejector sleeves 162 (FIG. 12) then retract so that pin press out unit 36 and retriever 104 is ready to retrieve the next set of cast rotors 110 at the appropriate time in the cycle. Since the loading of new rotor preforms 16 into compensator sleeves 46, the insertion of the preforms 16 into the die cavities and the ladling of a new shot of molten metal can be accomplished simultaneously with the pin press out and rotor ejection, the overall cycle time for the process is substantially reduced. Once the operator has started the cycle, all that is necessary is to supply rotor preforms 16 to the magazine loading unit 26 and remove the cast rotors from chutes 170.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A method for die casting end rings and conductor bars on motor rotors comprising the steps of:

providing a compensator mechanism comprising a compensator sleeve having a breech opening in a side thereof and a compensator received in the sleeve for reciprocal movement along a first axis, providing a die plate closing off one end of the compensator sleeve to form a die cavity, the die plate and compensator sleeve being axially separable, storing a plurality of stacks of motor laminations, each stack held together by a stacking pin, on a loading rack positioned laterally on one side of the compensator mechanism and the first axis, causing one of the stacks to roll by gravity from the loading rack into the compensator sleeve through the breech opening thereof, pushing the stack forward in the compensator sleeve by the compensator into abutment with the die plate, injecting a charge of molten metal into the die cavity formed by the compensator, compensator sleeve and die plate on and through the stack to form end rings and conductor bars on the stack to thereby form a rotor, then axially separating the die plate and compensator sleeve, moving a retriever laterally from said one side of the first axis and perpendicularly toward said first axis to an unload position interposed between the compensator sleeve and die plate, the retriever having an opening aligned with the compensator sleeve when it is moved to its unload position, pushing the cast rotor out of the compensator sleeve and into the retriever opening and holding the rotor in the retriever opening, then retracting the retriever to a position on said one side of said compensator mechanism and said first axis, while the rotor is in the retriever and when the retriever has been retracted, pressing the stacking pin out of the rotor along a second axis substantially parallel to the first axis and ejecting the rotor out of the retriever opening along said second axis, after the retriever has retracted away from the compensator sleeve and die plate, bringing the die plate and compensator sleeve together, and subsequent to clearing of the retriever from between the compensator sleeve and die plate and prior to the injection of the rotor from the retriever opening, rolling another stack into the compensator sleeve and pushing the last mentioned stack forward in the compensator sleeve.

2. The method of claim 1 wherein there are a plurality of compensator sleeves, die cavities and retriever openings and the respective stacks are simultaneously: loaded into their respective compensator sleeves, pushed forward into their respective die cavities, having end rings and conductor bars cast thereon, and ejected from their compensator sleeves into the retriever openings.

3. The method of claim 2 wherein the respective pins are simultaneously pressed out of the rotors and the rotors are then simultaneously ejected from the retriever.

4. The method of claim 1 wherein the die plate and compensator sleeve are tightly urged together and the compensator tightly clamps the stack in the sleeve against the die plate during injection of the charge of molten material into the die cavity.

5. The method of claim 4 including providing a second plate against which is tightly clamped a side of the die plate opposite that which engages the compensator sleeve and injecting the charge of molten metal through the second plate and the die plate into the die cavity.

6. The method of claim 5 including the steps of separating the die plate and second plate after injection of the charge, clearing any metal scrap from between the die plate and second plate, and moving a die lubricant spray device between the separated die plate and second plate to spray the plate with a die lubricant.

7. The method of claim 6 including the step of vertically lowering and raising the spray device between the plates in a direction perpendicular to said first axis.

8. The method of claim 1 including the step of pushing the rotor partially out of the compensator sleeve by the compensator and then pushing the rotor completely out of the sleeve by a pusher element within the compensator.

9. The method of claim 1 including the step of clamping the rotor in the retriever opening by a spring actuated clamp element projecting radially into the retriever opening.

10. The method of claim 9 including the steps of clamping a plurality of rotors in their respective openings in the retriever by their respective spring actuated clamp elements.

11. The method of claim 1 including spraying die lubricant from the retriever into the compensator sleeve and against the die plate as the receiver is retracted.

12. The method of claim 1 including the step of urging an anvil against the rotor in retriever during pressing out of the pin in a direction opposite the direction that the pin is pressed out.

13. The method of claim 12 including retracting the anvil after the pin is pressed out to enable the rotor to be ejected from the retriever opening.

14. The method of claim 1 including the steps of pressing out the pin by a rod and ejecting the rotor from the retriever opening by a sleeve element concentric with the rod.

15. The method of claim 14 including the step of urging an anvil against the rotor in the retriever in a direction opposite the direction that the pin is pressed out during pressing out of the pin, and further including the step of retracting the anvil after the pin is pressed out to enable the rotor to be ejected from the retriever opening.

16. The method of claim 15 including pressing the pin through the anvil into a tube movable with the anvil.

17. The method of claim 1 including the step of moving the rotor down an inclined surface after being ejected from the retriever opening.

18. The method of claim 1 including the steps of pressing out the pin of the rotor and ejecting the rotor from the retriever opening in a direction generally opposite that along which the stack is pushed into the die cavity by the compensator.

19. The method of claim 1 including the steps of rolling the last mentioned stack to the compensator sleeve and pushing said stack forward against the die plate simultaneously with the pressing out of the pin and ejection of the rotor from the retriever opening.

* * * * *